US006181247B1

(12) United States Patent
Bremer et al.

(10) Patent No.: US 6,181,247 B1
(45) Date of Patent: Jan. 30, 2001

(54) DEVICE FOR SURVEYING ELECTRONICALLY PROTECTED ITEMS IN A MONITORED AREA

(75) Inventors: Peter Bremer, Beerfelden; Terence Clancy, Bensheim; Peter Schneider, Neckargemünd, all of (DE); David Stocks, Herts; Anthony Douglas, Saffron Walden, both of (GB)

(73) Assignee: Meto International GmbH, Hirschhorn (DE)

( * ) Notice: Under 35 U.S.C. 154(b), the term of this patent shall be extended for 0 days.

(21) Appl. No.: 09/403,757

(22) PCT Filed: Jun. 8, 1998

(86) PCT No.: PCT/EP98/03412

§ 371 Date: Oct. 29, 1999

§ 102(e) Date: Oct. 29, 1999

(87) PCT Pub. No.: WO99/00778

PCT Pub. Date: Jan. 7, 1999

(30) Foreign Application Priority Data

Jun. 25, 1997 (DE) ..... 197 26 986

(51) Int. Cl.[7] ..... G08B 13/14

(52) U.S. Cl. ..... 340/572.1; 340/572.7; 340/572.8; 340/551; 343/702

(58) Field of Search ..... 340/572.1, 572.7, 340/572.8, 551; 342/42, 51; 343/702

(56) References Cited

U.S. PATENT DOCUMENTS

| | | | | |
|---|---|---|---|---|
| 4,623,877 | * | 11/1986 | Buckens | 340/572.2 |
| 4,769,631 | * | 9/1988 | Copeland | 340/551 |
| 4,859,991 | * | 8/1989 | Watkins et al. | 340/572.2 |
| 5,057,844 | * | 10/1991 | Rothstein | 342/51 |
| 5,121,103 | * | 6/1992 | Minasy et al. | 340/551 |
| 5,485,143 | * | 1/1996 | Keniston | 340/568.7 |
| 5,585,811 | | 12/1996 | Jetzer | 343/867 |

FOREIGN PATENT DOCUMENTS

| | | |
|---|---|---|
| 3844848C2 | 11/1995 | (DE) . |
| 4441122C1 | 12/1995 | (DE) . |
| 4437721A1 | 4/1996 | (DE) . |
| 4437844A1 | 4/1996 | (DE) . |
| 19503896A1 | 8/1996 | (DE) . |
| 19533983A1 | 4/1997 | (DE) . |
| 19544852A1 | 6/1997 | (DE) . |
| 0134087B1 | 3/1985 | (EP) . |
| 0352513A2 | 1/1990 | (EP) . |
| 0428384A2 | 5/1991 | (EP) . |
| 0668626A1 | 8/1995 | (EP) . |

* cited by examiner

*Primary Examiner*—Benjamin C. Lee
(74) *Attorney, Agent, or Firm*—Jones, Tullar & Cooper, P.C.

(57) ABSTRACT

The present invention relates to a device for electronically surveying items in a monitored area. The device is equipped with a transmitting and/or a receiving device. The aim of the surveying device is to provide an economical way for surveying electronically protected items. To this end, the surveying device is made up of individual layers of material, which taken individually are flexible and possessed of a low level of resistance, but when combined are characterized by a high level of rigidity and resistance.

11 Claims, 4 Drawing Sheets

DEVICE FOR SURVEYING ELECTRONICALLY PROTECTED ITEMS IN A MONITORED AREA

FIELD OF THE INVENTION

The present invention relates to a device for monitoring electronically protected items in a monitored area, wherein the device is equipped with a transmitting and/or receiving unit.

1. Background of the Invention

Nowadays, devices for the purpose of electronically protecting goods have a widespread application in department stores and warehouses. Inventory losses due to theft can be decisively reduced by installing such devices. The electronic monitoring devices can usually be found in the entry, or respectively exit areas of department stores and warehouses in order to signal the unauthorized removal of the appropriately secured articles from the sales or storage areas.

The monitoring devices described in the prior art have the most diverse designs. For example, an antenna device is known from European Patent, 0 668 626 A1 a consisting of a housing for receiving the transmitting and receiving antennas and of a frame, which essentially extends along the exterior edge areas of the housing. In connection with the known device it has been provided in particular that the frame element provided at the upper edge of the housing is removable, so that the antenna device can be removed from, or respectively inserted into the housing through the opening made.

2. Summary of the Invention

The object of the present invention is to provide a cost-effective device for monitoring electronically protected articles.

The object is attained in that the device is constructed of individual layers of material, wherein each one of the material layers by itself is flexible and has little strength, while in combination the material layers are distinguished by great rigidity and strength. In accordance with the present invention the effect is employed, wherein by combining individual layers of relatively little stability it is possible in the end to achieve a strength and rigidity which exceeds the sum of the strength and rigidity of the individual layers by a multiple. Since the demands made on the individual material layers—their stability in particular should be mentioned here—can be relatively low, the device in accordance with the present invention can be produced very cost-effectively.

In accordance with an advantageous further embodiment, the device in accordance with the present invention is composed of the following layers: a first lateral wall made of a bendable material, a filler made of a flexible material, a support layer made of a flexible material, whose surface is structured in such a way that it is suitable for receiving the transmitter coils and/or the receiver coils, and a second lateral wall of a bendable material.

To prevent interfering signals coming from outside the monitored zone from reducing the detection rate within the monitored zone, in accordance with a first alternative the first lateral wall is made of a material which shields electromagnetic radiation. All conductive materials can be used as suitable materials. In accordance with a preferred embodiment the lateral wall is made of aluminum. It has been shown that a thickness of the aluminum layer in the millimeter range is completely sufficient.

A variation of the above described embodiment provides that a separate, bendable shielding layer is provided between the first lateral wall and the filer on the side facing away from the monitored zone. This shielding layer is also made of aluminum, which can have a thickness of a few tenths of a millimeter.

In accordance with an advantageous further embodiment of the device in accordance with the present invention it is provided that the individual layers are fixedly connected with each other at least in spots. In the simplest case the layers are glued together.

It has been found to be cost-effective and completely sufficient for achieving the required stability if the filler is made of foamed polystyrene or a foamed filler. When using foamed polystyrene, it has a shape which is designed complementary to the corresponding side of the support layer. If a foamed filler is used, it is applied directly to the appropriate location of the support layer.

In accordance with an advantageous embodiment of the device of the present invention, the support layer is a compressed fiberglass material. The use of an injection-molded element would of course also be possible.

In order to meet the requirements of customary safety standards in public places, the lateral walls of the device in accordance with the present invention are made of a highly non-flammable material.

Furthermore, an advantageous further development of the device in accordance with the present invention proposes the provision of lateral profiles and at least one cover profile, which enclose the lateral areas of the material layers.

The present invention will be explained in greater detail by means of the following figures.

DECRIPTION OF THE PREFERRED EMBODIMENTS

Figure 1:
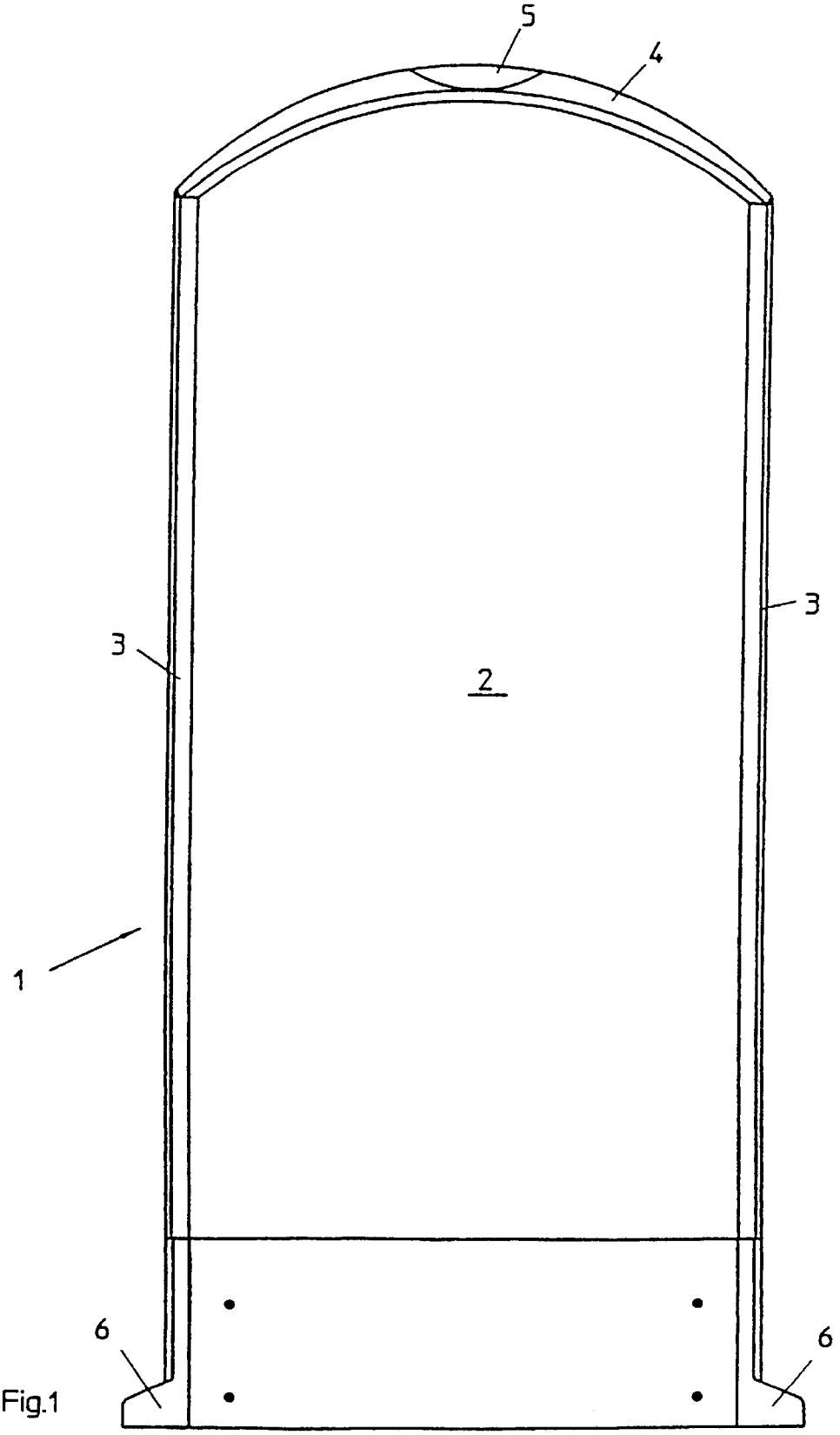
FIG. 1, is a top view of an embodiment of the device in accordance with the present invention.

FIG. 1 represents a top view of an embodiment of the device 1 in accordance with the present invention. The device 1 is bordered on its front and back respectively by a lateral wall 2*a,* 2*b.* As already mentioned, the lateral wall facing away from the monitored zone can be simultaneously embodied as a shielding layer 12. On order to meet safety requirements in public installations, the lateral walls have been made of a highly non-flammable material.

Figure 4:
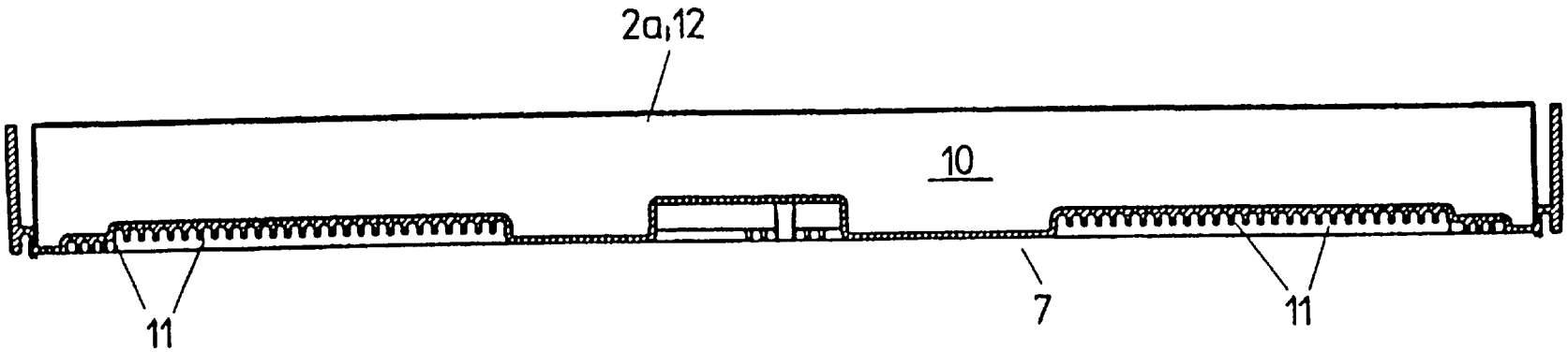
FIG. 4, is a cross section through the device in accordance with the present invention along the lines IV—IV in FIG. 3.

As represented in FIG. 4, two further layers have been arranged between the two lateral walls 2*a,* 2*b:* a support layer 7 with a structured surface for receiving the receiver coils (8) and/or the transmitter coils (9), and a filler 10. While the support layer preferably consists of compressed fiberglass material, the filler is either foamed polystyrene or a foamed filler. The individual layers of the device in accordance with the present invention are connected with each other at least in spots. In the simplest case they are glued together.

In order to give the monitoring device 1 a pleasing design, the lateral areas and the upper areas of the material layers are closed off by means of lateral profiles 3 and a cover profile 4. An alarm device is located in the area of the cover profile, which usually is designed in such a way that it acoustically and visually indicates the detection of an electronically secured article in the monitored zone.

The device 1 is fixed in place on the floor by means of the laterally attached fastening elements 6, i.e. a flat element of relatively great height is placed free-standing in the exit or cash register area of a department store and is fastened far below its center of gravity. If it is moreover considered that the device 1 is located in an area in which the public moves about greatly, wherein the customers usually are moving with shopping carts, the high demands made on the stability of the device become apparent. While with all devices known up to now the required stability could only be achieved by using correspondingly stable and expensive materials, the device in accordance with the present invention surprisingly succeeds in achieving a comparable effect by means of the combination of bendable, or respectively flexible and cost-effective materials.

Figure 2:
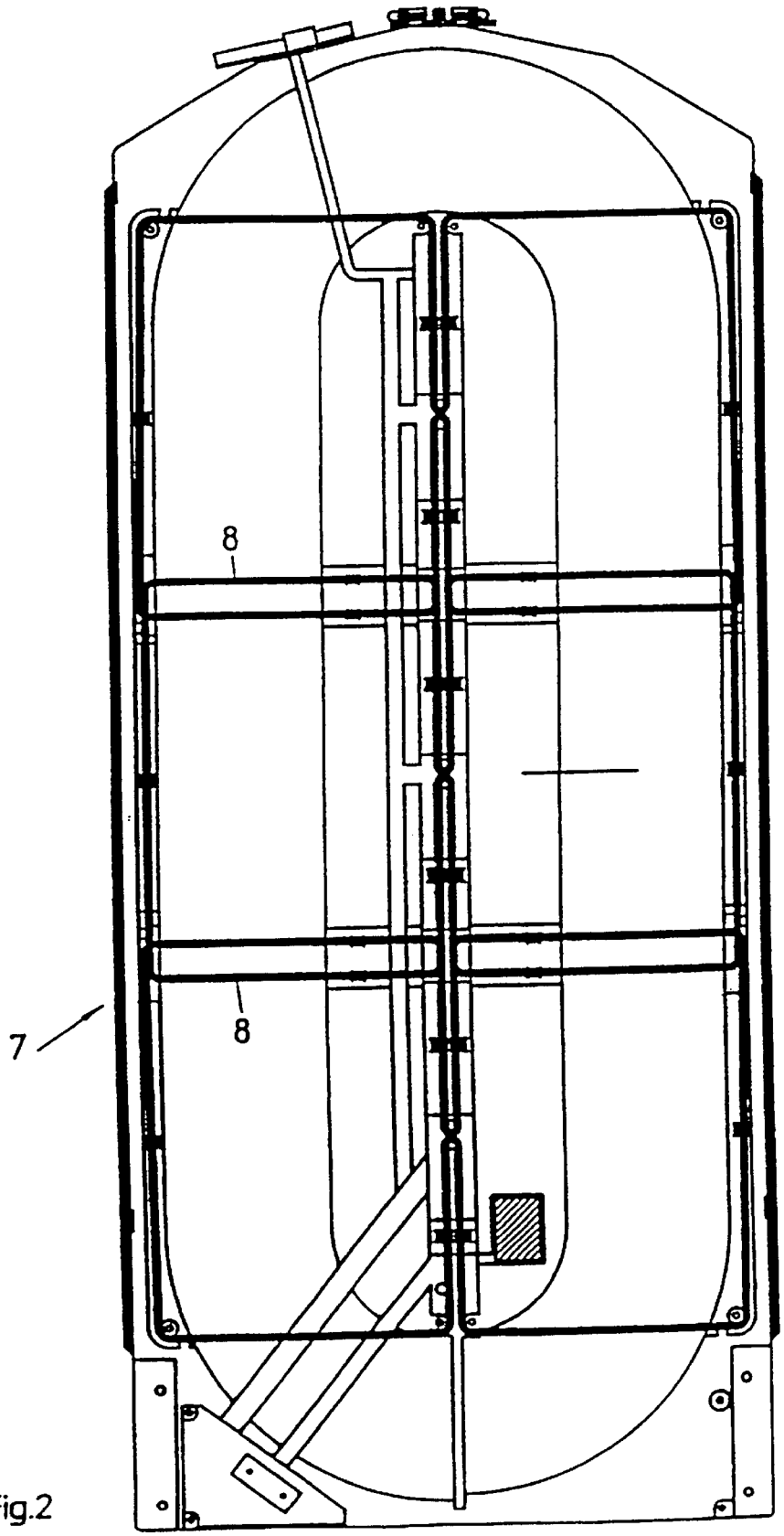
FIG. 2, is a top view on the support layer with assembled receiver coils.

FIG. 2 shows the structured support layer 7 with the assembled receiver coils 8 in a top view. The three receiver coils 8, arranged one on top of the other, have the shape of horizontal figures eight. A relatively even detection rate within individual areas of the monitored zone is achieved by means of this. The receiver coils are embedded in depressions in the support layer 7.

Figure 3:
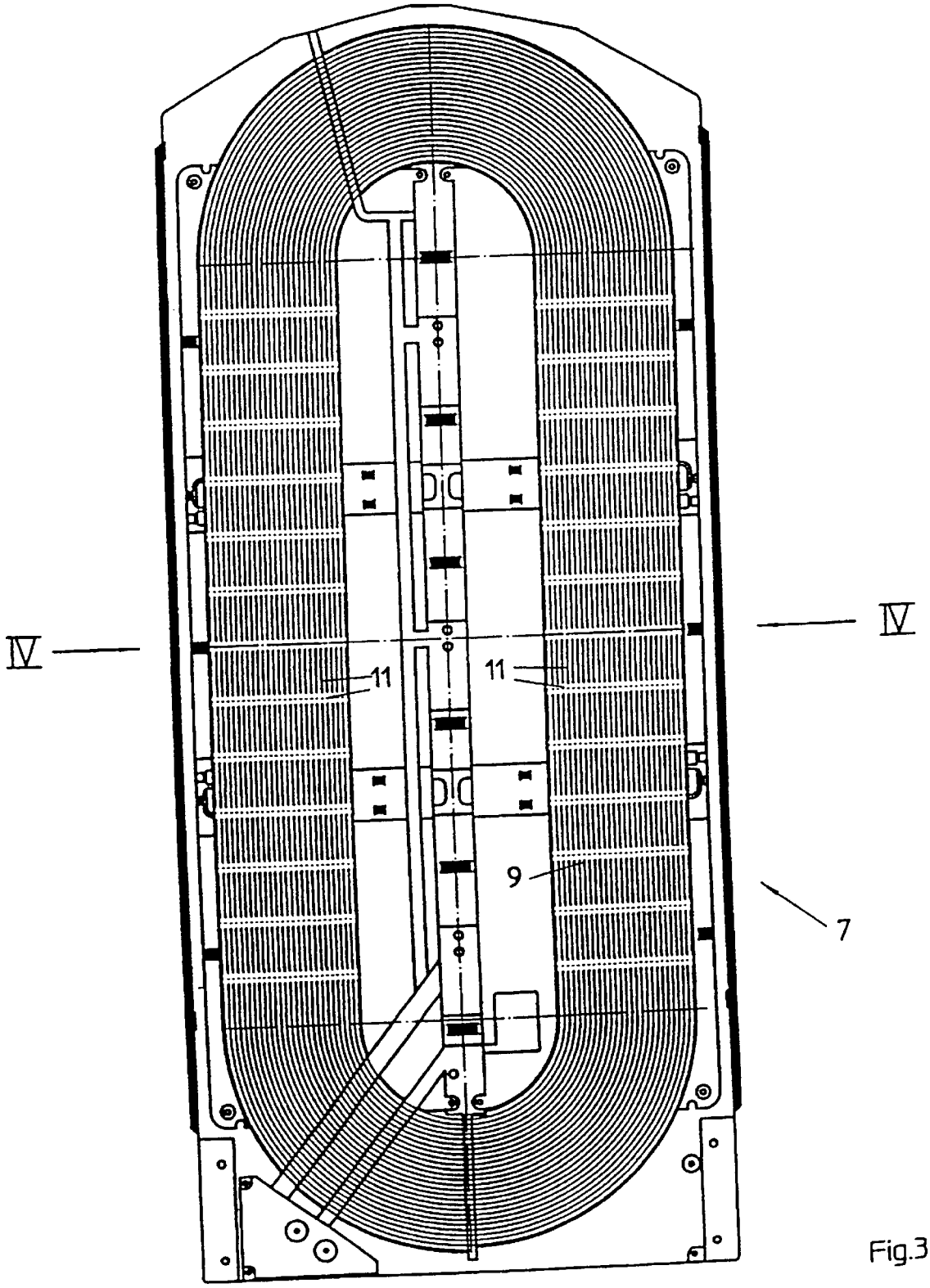
FIG. 3, is a top view on the support layer with an assembled transmitter coil.

A top view on the support layer 7 with the assembled transmitter coil 9 is represented in FIG. 3. The structured top of the support layer 7 has channel-shaped, circumferential depressions 11, into which the wire of the transmitter coil has been inserted. Since the receiver coils 8, as well as the transmitter coils 9, as well as all other electrical connections and junctions extend inside the support layer 7, it is possible to attach the second lateral wall 2*b* directly to the support layer 7. Here, a sufficiently large contact surface is available to achieve the stability required for the device in accordance with the invention.

What is claimed is:

1. A device for the electronic monitoring of articles in a monitored zone equipment with at least one of a transmitter and receiver device, comprising:

a plurality of individual material layers, each being bendable and having little strength, wherein said plurality of individual material layers, while in combination, having great rigidity and strength.

2. The device as defined in claim 1, wherein the combination of individual layers comprises:

a first lateral wall of a bendable material formed from one of said plurality of individual material layers;

a filler of a bendable material formed from one of said plurality of individual material layers;

a support layer of a bendable material formed from one of said plurality of individual material layers, said support layer being structured such that it is suitable for receiving at least one of: transmitter coils and receiver coils of the transmitter and receiver, respectively.

3. The device as defined in claim 2, wherein said first lateral layer is made of a material which shields electromagnetic radiation.

4. The device as defined in claim 2, wherein the combination of individual layers further comprises:

a bendable shielding layer provided between said first lateral wall and said filler on the side facing away from the monitored zone.

5. The device as defined in claim 4, wherein said bendable shielding layer comprises an electrically conductive aluminum layer, whose thickness is less than 1 mm.

6. The device as defined in claim 2, wherein said filler is made of foamed polystyrene.

7. The device as defined in claim 2, wherein said filler is made of a foamed filler.

8. The device as defined in claim 2, wherein said support layer comprises compressed fiberglass material.

9. The device as defined in claim 2, wherein said lateral walls, comprise a material which is highly non-flammable.

10. The device as defined in claim 2, wherein the combination of individual layers further comprises:

lateral profiles, and at least a cover profile, which enclose lateral areas of the combination of individual layers.

11. The device as defined in claim 1, wherein said plurality of individual material layers are fixedly connected with each other at least in spots.

* * * * *